United States Patent [19]

Huel

[11] Patent Number: 4,571,869

[45] Date of Patent: Feb. 25, 1986

[54] SIGNBOARDS

[76] Inventor: Georges Huel, 65 Sherbrooke St. East, Montreal, Quebec, Canada, H2X 1C4

[21] Appl. No.: 589,466

[22] Filed: Mar. 14, 1984

[30] Foreign Application Priority Data

Apr. 26, 1983 [CA] Canada ..... 426735

[51] Int. Cl.[4] ..... G09F 7/00

[52] U.S. Cl. ..... 40/605; 40/610; 217/65

[58] Field of Search ..... 40/605, 610; 52/512, 52/510; 217/65; 446/123, 125; 403/381; 52/308, 306

[56] References Cited

U.S. PATENT DOCUMENTS 1,468,786 9/1923 Knechtel ..... 217/65
2,596,995 5/1952 Hamilton ..... 217/65

FOREIGN PATENT DOCUMENTS 1328637 8/1973 United Kingdom ..... 403/381

*Primary Examiner*—Gene Mancene
*Assistant Examiner*—Cary E. Stone
*Attorney, Agent, or Firm*—Cushman, Darby & Cushman

[57] ABSTRACT

A breakdown type signboard includes at least one elongated "U" shaped panel and two side members with the side members having tenons and with the legs of the "U" shaped panel having mortise elements for interfitting with the tenons. The tensons may be partly hollow to receive a screw or other enlarging element to lock the "U" shaped panel to the side members.

10 Claims, 6 Drawing Figures

SIGNBOARDS

DESCRIPTION

This invention relates to signboards for use in advertising or for use as signage, and which are of the breakdown type, that is they are constructed from a plurality of parts which are assembled together in a detachable manner.

Such signboards have been proposed previously but each consisted of a unique construction, that is depending on the use, some or all of the elements were applicable only to one application. Such signboards are shown in the following patents: U.S. Pat. No. 3,015,899 (ENSIGN); U.S. Pat. No. 3,565,152 (COHN); U.S. Pat. No. 4,059,914 (DOBSON); U.S. Pat. No. 4,209,927 (DONATELLE); U.S. Pat. No. 4,174,580 (SANDERS) and U.S. Pat. No. 3,634,960 (DON CARLOS).

It is an object of the present invention to provide a signboard construction in which the components do not require modification so as to be usable in other applications.

It is also an object of the present invention to provide a signboard which is readily broken down or assembled.

It is a further object of the invention to provide a signboard which comprises panels which can be easily and rapidly replaced.

It is a still further object of the invention to provide a signboard or panel in which the complexity and cost of interconnecting the components is reduced.

Figure 1:
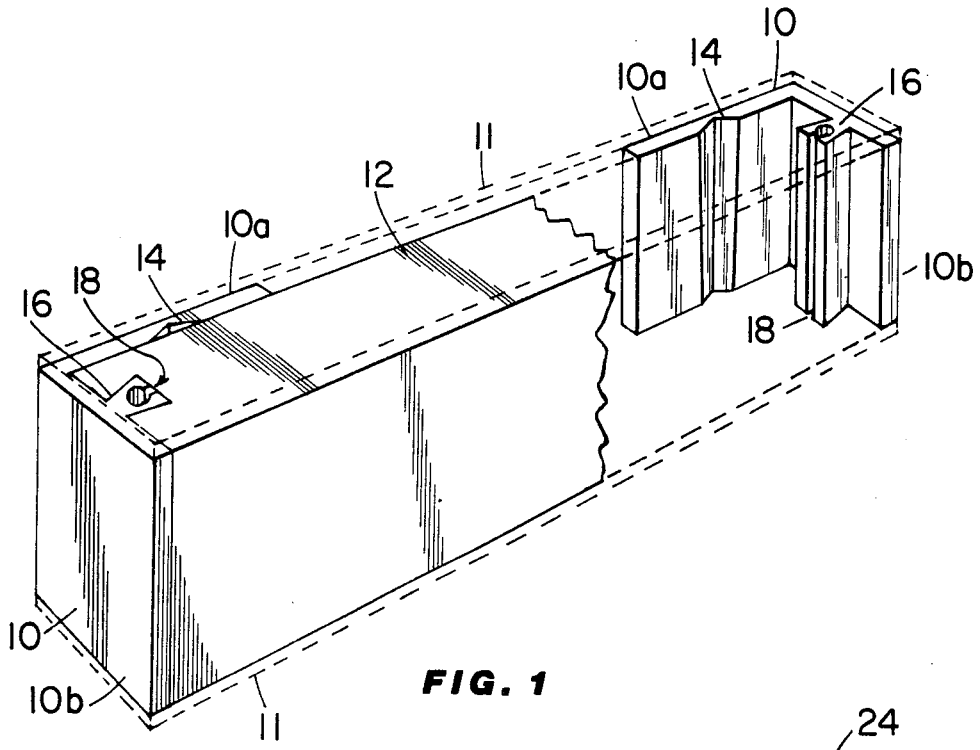
Figure 2:
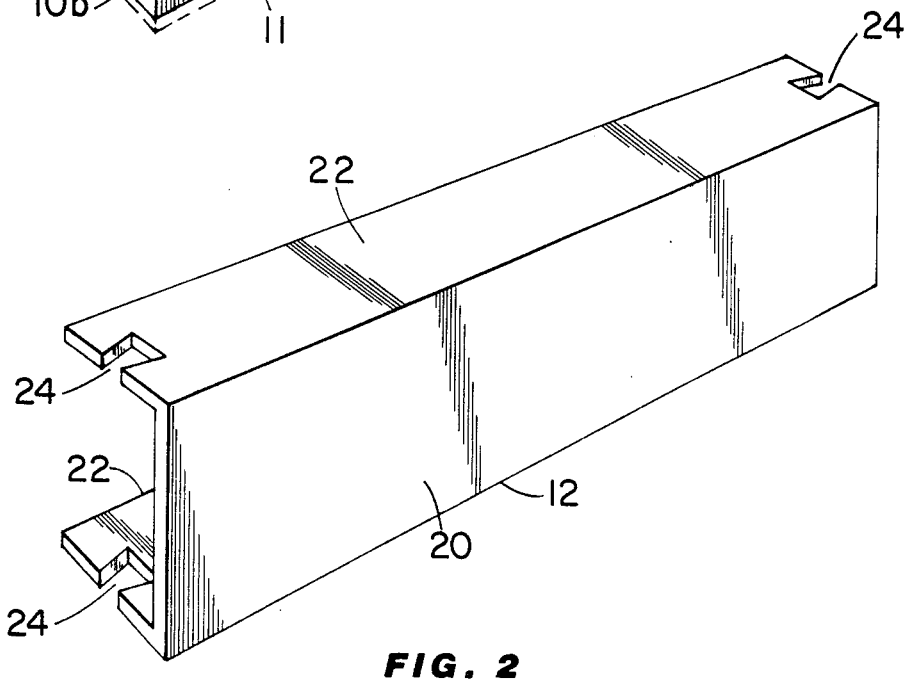
Figure 3:
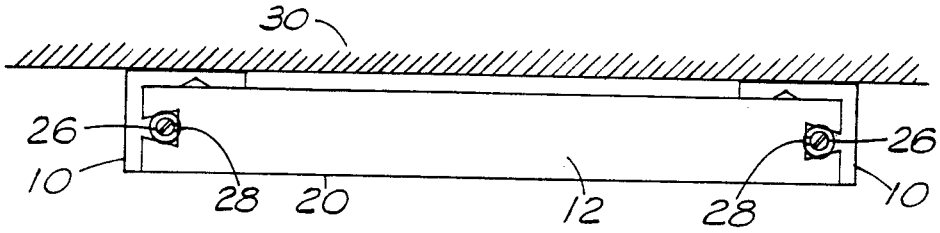
Figure 4:
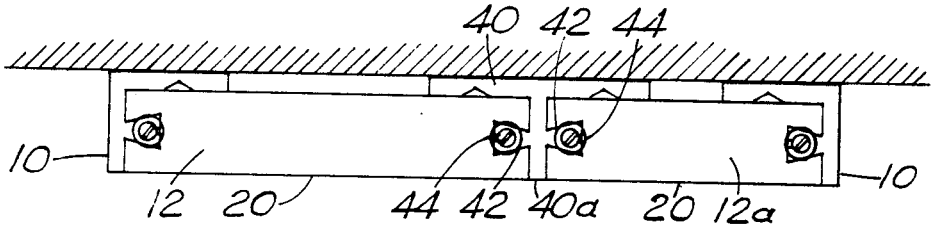
Figure 5:
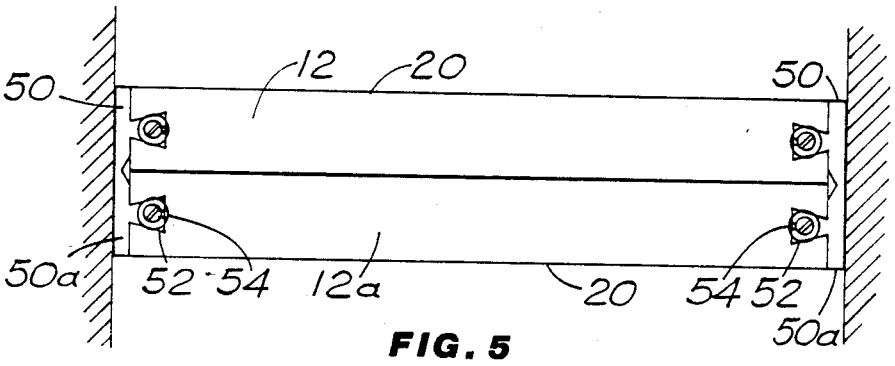
Figure 6:
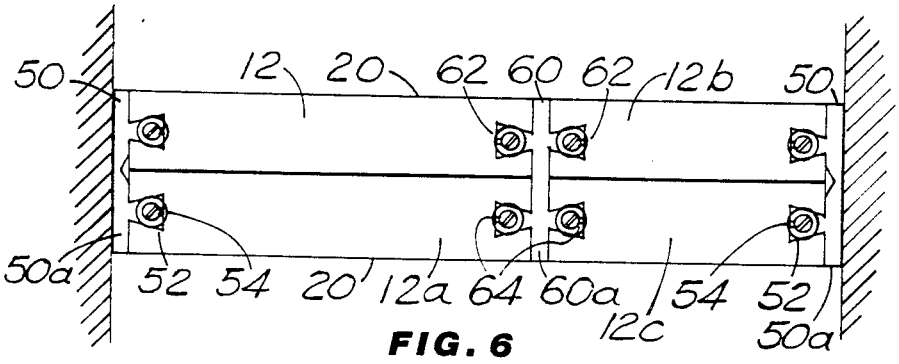

These and other objects will become apparent from the following embodiments of signboards in accordance with the invention, which will now be described, by way of example only, with reference to the accompanying drawings, in which, FIG. 1 is a perspective view of one embodiment of a signboard in accordance with the invention, FIG. 2 is a perspective view of a panel for use in a signboard in accordance with the invention, FIG. 3 is a plan view showing the signboard in FIG. 1, attached to a wall or other support, FIG. 4 is a plan view of an alternative construction of a signboard in accordance with the invention, FIG. 5 is a plan view of a further alternative construction of signboard in accordance with the invention, and FIG. 6 is a plan view of a still further alternative construction of signboard in accordance with the invention.

Referring to FIGS. 1 and 2 of the drawings, a signboard comprises two side members 10 and a panel member 12 which are detachably interconnected by means which will be described later.

Each side member 10 comprises an extruded member which is "L" shaped in cross-section, one leg 10*a* including a vee shaped groove 14 which extends over the full length of the member, whilst the other leg 10*b* includes a projection 16, which is substantially triangular in cross-section and also extends over the full length of the member 10.

As can be seen from FIG. 1 of the drawings, the projection 16 progressively increases in width as it extends away from the leg 10*b* of the member 10.

A slot or recess 18 is provided in the projection 16, and extends along the length thereof, which slot or recess is substantially circular in cross-section.

The panel member 12 also comprises an extruded member which is channel shaped in cross-section, and includes a facia portion 20, and two rearwardly directed flanges 22 which are disposed at right angles to the facia portion 20.

A slot 24 is formed in each end of both flanges 22 and is substantially triangular in cross-section so as to be compatible with the projections 16 on the side members 10. In addition to being the same shape as the projections 16, the slots 24 are of such a size that they are slidable over the associated projection 16 on the member 10.

It will also be understood that the slots 24 at each end of the upper flange 22 are in line with the slot 24 in the adjacent end of the lower flange 22.

The panel 12 and side members 10 may be assembled together prior to the signboard being attached to a support, as shown in FIG. 1 of the drawings, with the projection 16 on each side member 10 engaged in the slots 24 in the panel. It will be seen that the projections and associated slots from mortise and tenon joints, and thus the side members cannot be separated from the panel by transverse movement of the side members relative to the panel 10.

In order to prevent movement of the panel 12 and side members 10 relative to each other along the length of the projections 16, a self tapping screw 26 and washer 28 are employed, as shown in FIG. 3 of the drawings. Any other appropriate retaining means may also be used.

As can be seen from FIG. 1 of the drawings, the length of the side members 10 is the same as the depth of the panel member 12 whereby the ends of the members 10 are co-terminous with the outer surface of the flanges 22.

Thus when the screw 26 is screwed into the slot or recess 18 at each end of each projection 16, and with the washer 28 interposed between the head of the screw and the side member movement of the panel 12 along the projections 16 is prevented.

If required for aesthetical reasons, a cover 11 extending over the whole length of panel 12 and the outer edges of side members 10 may be provided. The cover 11 is held in place by screws 26.

Whilst in the above example the signboard has been assembled together prior to being mounted on a support, as shown in FIG. 3 of the drawings, the side members 10 may be attached to a support member, in this instance a wall 30, prior to positioning and securing the panel 12 between the side members.

The side member 10 may be secured to the wall 30 by screws which are located in the groove 14 whereby the screw heads do not project above the inner surface of the side member 10.

It will be appreciated that whilst the signboard shown in FIGS. 1 and 3 of the drawings is illustrated as being attached to a wall, it may be supported in any other convenient way, well known to those skilled in the art and which do not form part of the invention.

It will also be appreciated that whilst in the above described example, only one panel 10 has been described, a plurality of such panels may be employed together with side members 12 of a length selected in accordance with the number of panels to be used.

In such an assembly only the upper and lower panels are secured against movement along the length of the projections 16, the panels between the upper and lower panels thus being secured by the upper and lower panels.

Referring now to FIG. 4 of the drawings, there is shown an alternative construction of signboard in accordance with the invention in which the signboard is similar to that described with reference to FIG. 1, but comprises two sets of panels.

The signboard comprises two side members 10, constructed as described with reference to FIG. 1 of the drawings and an intermediate member 40. The intermediate member 40 is "T" shaped in cross-section, the leg 40*a* of the tee being provided with a projection 42 on each side thereof, which as on the side members 10 is substantially triangular in cross-section and extends over the whole length of the member 40. Again as in the case of the side members 10, the projections 42 progressively increase in width as they extend away from the leg 40*a*.

In addition, a slot or recess 44 is provided in each projection 42 and extends along the full length of the projection. As in the previous example, the slots or recesses 44 are substantially circular in cross-section.

As in the previous construction, the side member 10 and intermediate member 40 can be secured to a support, such as a wall, not shown, as arranged in FIG. 4, and panels 12 mounted between the left hand member 10 and the intermediate member 40 by engaging the slots 24 over the projections 16 and 42 respectively, and then securing the upper and lower panels 12 in the manner described with reference to FIG. 1 by means of screws and washers.

Additional panels 12*a* are then interposed between the right side member 10 and the intermediate member 40 in the manner previously described and the upper and lower panels secured to the side and intermediate members 10 and 42.

As can be seen from FIG. 4 of the drawings, the panels 12*a* are shorter than panels 12 but could be of the same length as required. Similarly, each set of panel may be of the same height or of different heights as required.

In the signboard shown in FIG. 5 of the drawings, the side members 50 comprise a flat plate 50*a* having two projections 52 on one face thereof together with a vee shaped groove, all of which extend over the full length of the side member 50.

Similarly, as in the previous constructions, the projections 52 are substantially triangular in cross-section and progressively increase in width as they extend away from the member 50. Each projection 52 is also provided with a slot or groove 54 which extends over its full length and is circular in cross-section.

As can be seen from FIG. 5 of the drawings, the side members 50 can support two panels, or two sets of panels 12 and 12*a* side by side with the facias of each panel or sets of panels facing outwardly whereby signs or other information can be displayed on both sides of the signboard.

FIG. 6 of the drawings shows a signboard similar to that shown in FIG. 5 of the drawings, but comprising four sets of panels 12, 12*a*, 12*b* and 12*c*.

The signboard comprises two side members 50 as described with reference to FIG. 5 of the drawings and an intermediate member 60. The intermediate member 60 comprises a plate 60*a* having two spaced apart projections 62 on each face thereof, each projection being substantially triangular in cross-section and extending over the full length of the member 60.

Similarly, as in the previous examples, the projections 62 progressively increase in width as they extend away from the member 60 and each is provided with a slot or groove 64 of substantially circular cross-section which extends throughout the full length of the projection 62.

As can be seen from the drawing, two panels or two sets of panels 12 and 12*a* can be supported between the left hand member 50 and the intermediate member 60, in side by side relationship with their facias 20 disposed outwardly. The panels, or the upper and lower panels of each set are then secured in position in the manner described with reference to FIG. 1 of the drawings.

Additional panels 12*b* and 12*c* are then mounted between the right hand side member 50 and the intermediate member 60, in the manner above described and similarly secured in position.

As in the construction of FIG. 4, the right hand panels are shorter than the left hand panels, but both sets of panels may be of the same length. Whilst in the examples illustrated in FIGS. 4 and 6, only one intermediate member has been shown, additional such members may be employed according to the length of sign desired.

Similarly, the length of the side and intermediate members may be selected according to the depth of sign required.

From the foregoing examples, it will be appreciated that a signboard in accordance with the invention is readily assembled and dismantled in such a way to facilitate the modification of the information or other indicia appearing thereon.

It will also be appreciated that the side and intermediate members can accommodate panels of different length and cross-sectional width, provided that the flanges are dimensionally the same.

The panels, side members and intermediate members may be extruded, constructed and fabricated from metal such as aluminium, one of the plastics or any other suitable material.

Furthermore, the exact shape of the mortise and tenon may be varied as required, provided lateral movement of the side members in relation to the panels is prevented.

It will also be appreciated that instead of the projections or tenons being formed on the side members, they may be formed on the panels, whilst the grooves or mortises are formed in the side members.

The embodiments of the invention in which an exclusive property or privilege is claimed are defined as follows:

1. A signboard with easily replaceable indicia carrying faces comprising a first member including a back panel having opposite side edges and side walls extending substantially perpendicularly from said respective side edges, said side walls having a selected length and free ends, said first member having a selected length between said side walls, a side member including a front panel having opposite side edges and side walls extending substantially perpendicularly from said side edges of said front panel, said first and second members having mortise and tenon joints for interconnecting said first and second members, said joints being spaced from said front and back panels of said members when said members are interconnected, said signboard including retaining means for detachably connecting said side walls to prevent relative movement.

2. A signboard as claimed in claim 1 in which each tenon is provided with a slot along its length.

3. A signboard as claimed in claim 2 in which the retaining means are screws introduced in said slot.

4. A signboard as claimed in claim 1, 2 or 3 in which at least two of the side walls are provided with two tenons each.

5. The signboard as claimed in claim 1 wherein at least one of said side walls of said first member includes a surface having mortise means for connection with a third member having a front panel.

6. The signboard as claimed in claim 1 in which said joints comprise a slot formed in one of said members and a complementary shaped projection formed on the other of said members with said slot and projections each having a triangular cross sectional shape.

7. A signboard as claimed in claim 6, in which each projection is provided with a slot of substantially circular cross-section along its length.

8. A signboard as claimed in claim 6, in which the retaining means comprises screws which engage said joints of said first member.

9. A signboard as claimed in claim 6, further including another member having two spaced apart projections for cooperating with two separate said second members.

10. A signboard as claimed in claim 6 wherein said members are extruded metal.

* * * * *